US006082229A

United States Patent [19]

Shih

[11] Patent Number: 6,082,229

[45] **Date of Patent: *Jul. 4, 2000**

[54] RETAINING DEVICE OF SOCKET SPANNER

[76] Inventor: Leo Shih, No. 5, Lane 54, San Min Rd., Sec 3, Taichung, Taiwan

[ * ] Notice: This patent is subject to a terminal disclaimer.

[21] Appl. No.: 09/122,594

[22] Filed: Jul. 25, 1998

[51] Int. Cl.[7] ..... B25B 13/02

[52] U.S. Cl. ..... 81/125

[58] Field of Search ..... 81/125, 451, 452, 81/180.1

[56] References Cited

U.S. PATENT DOCUMENTS

| | | | |
|---|---|---|---|
| 3,665,791 | 5/1972 | Carr | 81/125 |
| 3,834,253 | 9/1974 | Carr | 81/125 |
| 3,835,737 | 9/1974 | Carr | 81/125 |
| 4,644,831 | 2/1987 | Yang | 81/125 |
| 4,787,278 | 11/1988 | Bononi | 81/125 |
| 5,042,333 | 8/1991 | Huang | 81/125 |

*Primary Examiner*—David A. Scherbel
*Assistant Examiner*—Joni B. Danganan
*Attorney, Agent, or Firm*—W. Wayne Liauh

[57] ABSTRACT

A socket spanner is provided with a retaining device consisting of a socket and an elastic body. The socket has a driven end with a hexagonal hole which is provided in one of six inner side walls thereof with a receiving portion. The elastic body is securely fitted into the driven end such that a retaining side of the elastic body is securely retained in the receiving portion of the hexagonal hole of the driven end so as to prevent the elastic body from slipping out of the driven end, and that a protruded edge of the retaining side of the elastic body is capable of holding securely a nut which is engaged with the driven end of the socket.

4 Claims, 8 Drawing Sheets

RETAINING DEVICE OF SOCKET SPANNER

FIELD OF THE INVENTION

The present invention relates generally to a socket spanner, and more particularly to a retaining device of the socket spanner.

BACKGROUND OF THE INVENTION

As shown in FIG.1, the U.S. patent application Ser. No. 08/672,859, filed by the same inventor as the present invention discloses a socket 20 having a fitting end 22 which is provided in the inner wall thereof with two grooves 221 disposed diametrically opposed relative to each other. The fitting end 22 is further provided in proximity of one end thereof with a circular slot 222. An elastic wire 24 is fitted into the fitting end 22 of the socket 20 such that a retaining side 241 of the elastic wire 24 is retained in the grooves 221 of the fitting end 22, and that an end portion 244 of the elastic wire 24 against the circular slot 222 of the driven end 22. As a result, a protruded edge 242 of the retaining side 241 of the elastic wire 24 is capable of retaining a nut which is engaged with the driven end 22 of the socket 20. In the meantime, the retaining side 241 is capable of preventing the elastic wire 24 from slipping out of the socket 20 at the time when the nut is taken out of the socket 20. As shown in FIG. 2, the structural integrity of the socket 20 can be undermined by the grooves 221 in the process of making the socket 20 by forging.

SUMMARY OF THE INVENTION

The primary objective of the present invention is therefore to provided a socket spanner with a retaining means free from the structural deficiency of the prior art described above.

In keeping with the principle of the present invention, the foregoing objective of the present invention is attained by a socket which is in turn provided in one of six sides thereof with a receiving portion. The driven end of the socket is provided with an elastic wire fitted thereinto such that a retaining side of the elastic wire is retained in the receiving portion of the hexagonal hole, thereby bringing about the retaining effect of the socket.

The foregoing objective, features, function, and advantages of the present invention will be more readily understood upon a thoughtful deliberation of the following detailed description of the present invention with reference to the accompanying drawings.

DETAILED DESCRIPTION OF THE INVENTION

Figure 1:
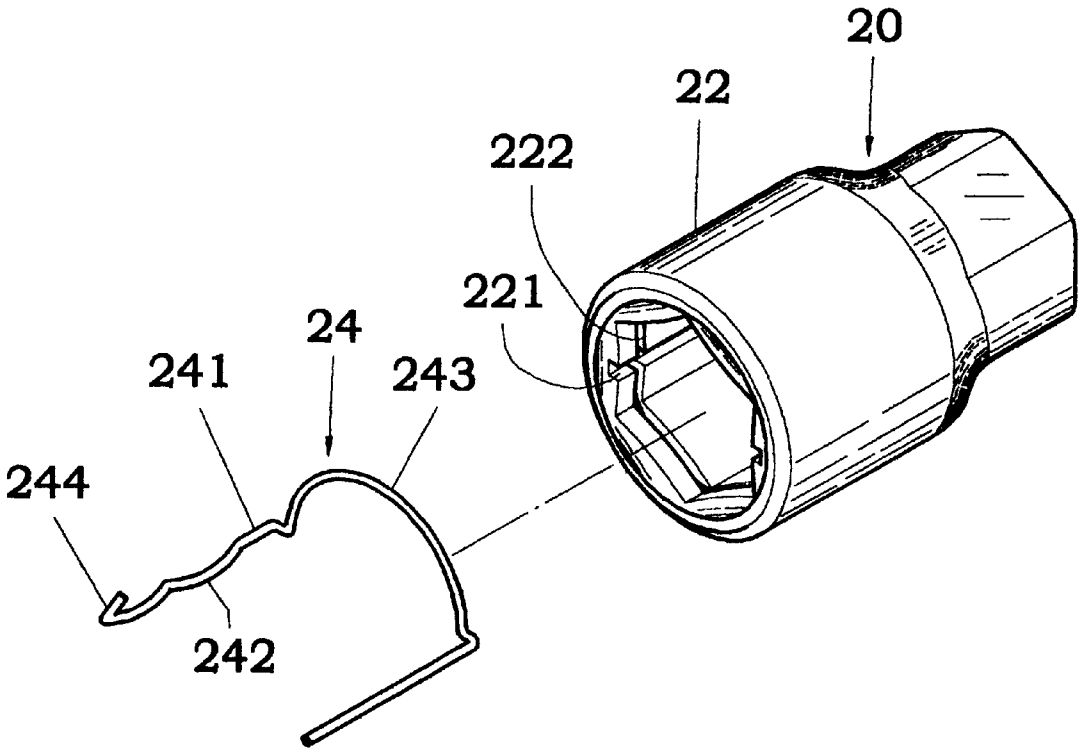
Fig. 1 PRIOR ART
FIG. 1 shows an exploded view of the prior art.
Figure 2:
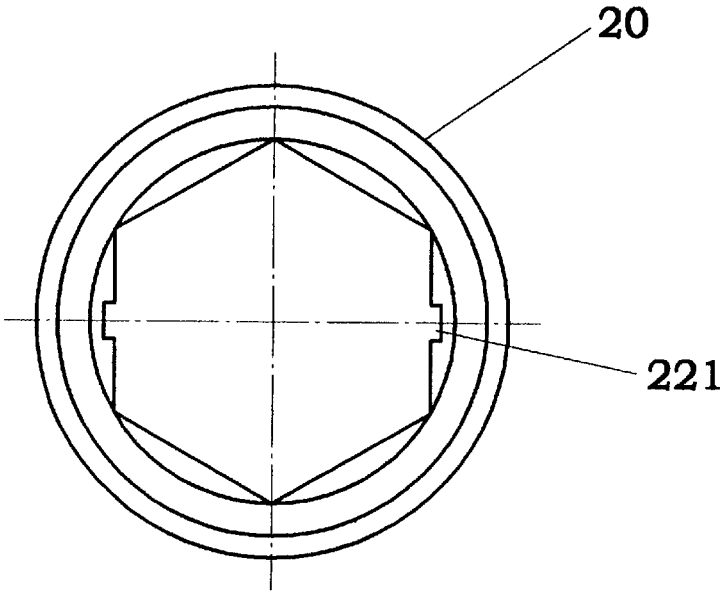
Fig. 2 PRIOR ART
FIG. 2 shows a schematic view of a driven end of a socket spanner of the prior art.
Figure 3:
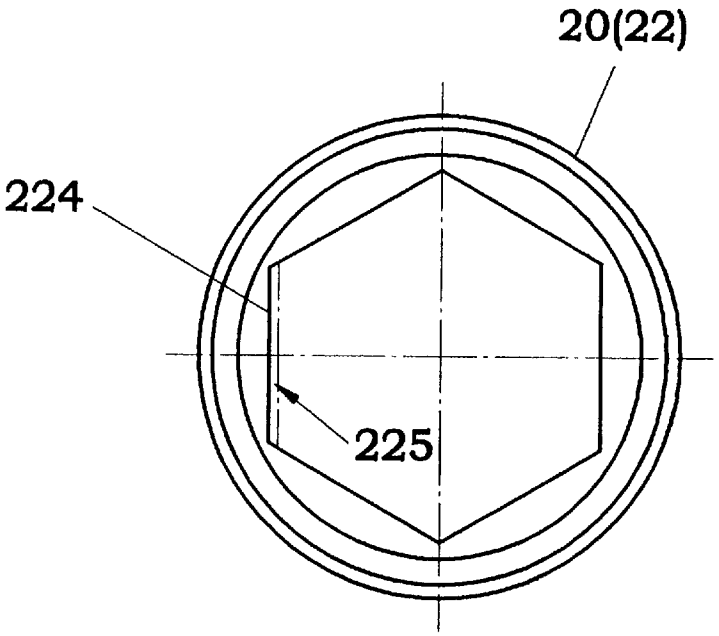
FIG. 3 shows a schematic view of a driven end of a socket spanner of the present invention.

As shown in FIG. 3, a socket spanner 20 of a first preferred embodiment of the present invention is provided with a driven end 22 having a hexagonal hole. One of the six inner side walls 224 of the hexagonal hole of the driven end 22 servers as a receiving surface 225 for receiving side 302, to be discussed later.

Figure 4:
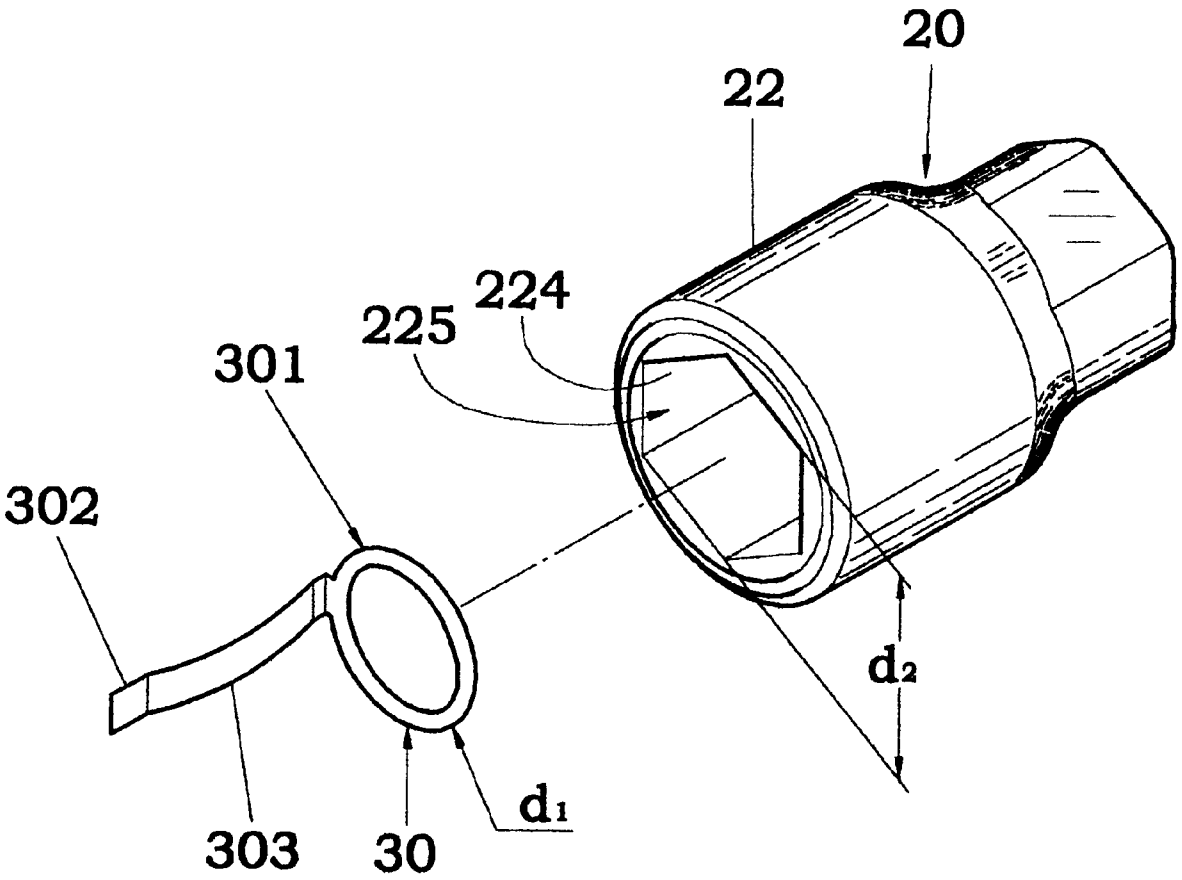
FIG. 4 shows an exploded view of the driven end of the socket spanner of the present invention.
Figure 5:
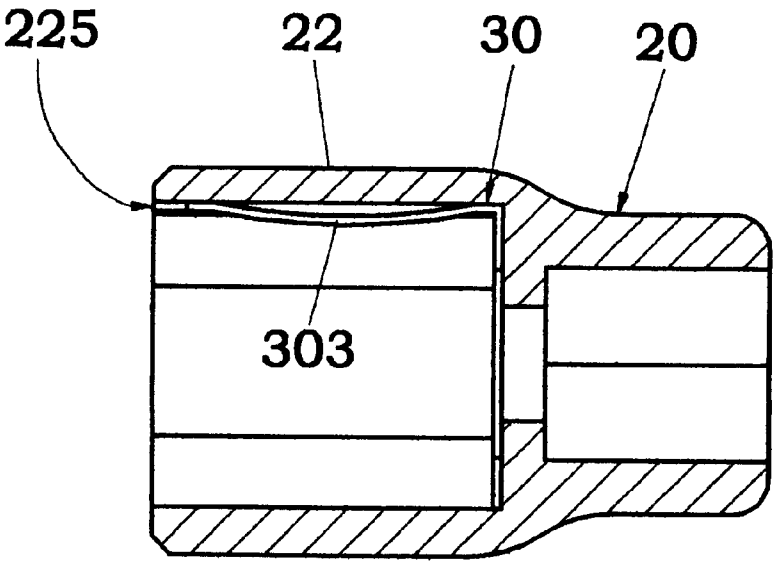
FIG. 5 shows a sectional schematic view of the present invention.

As shown in FIGS.4 and 5, the driven end 22 of the socket spanner 20 of the present invention is provided with an elastic body 30 which is composed of a press ring 301 and a retaining side 302 extending from the press ring 301 and having a protruded edge 303. The press ring 301 has an outer diameter, d1, which is slightly greater than an inner diameter, d2, of the hexagonal hole of the driven end 22. In combination, the elastic body 30 is forced into the driven end 22 by pressing such that the retaining side 302 of the elastic body 30 is retained in the receiving receiving surface 225 of the hexagonal hole of the driven end 22.

Figure 6:
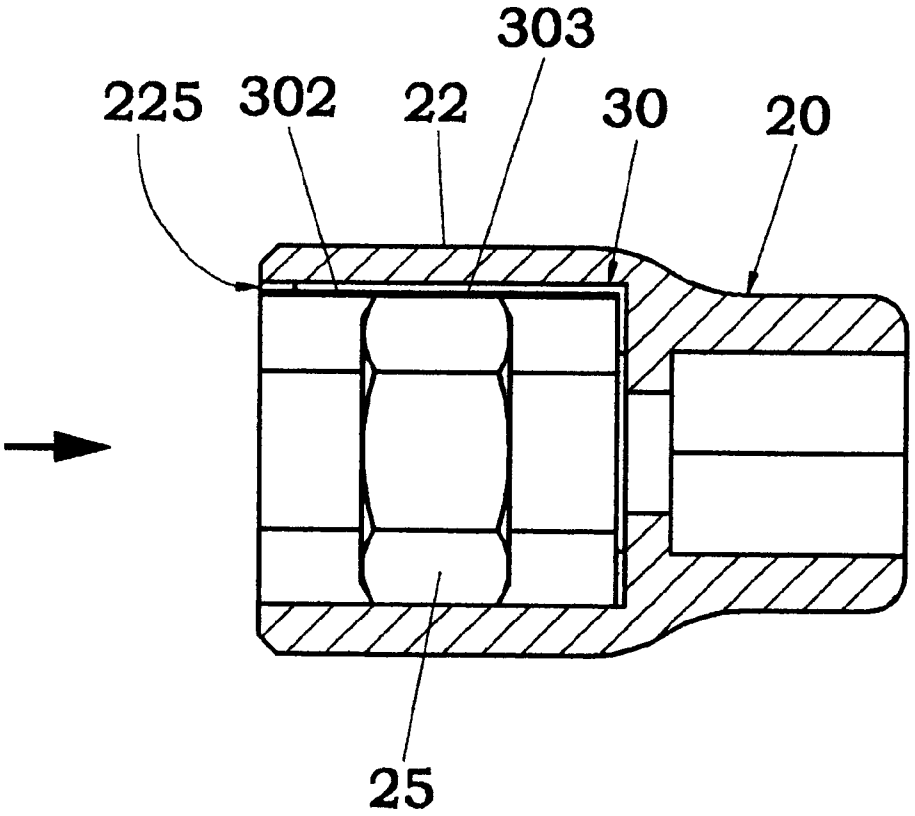
FIG. 6 shows a schematic view of the present invention at work.
Figure 7:
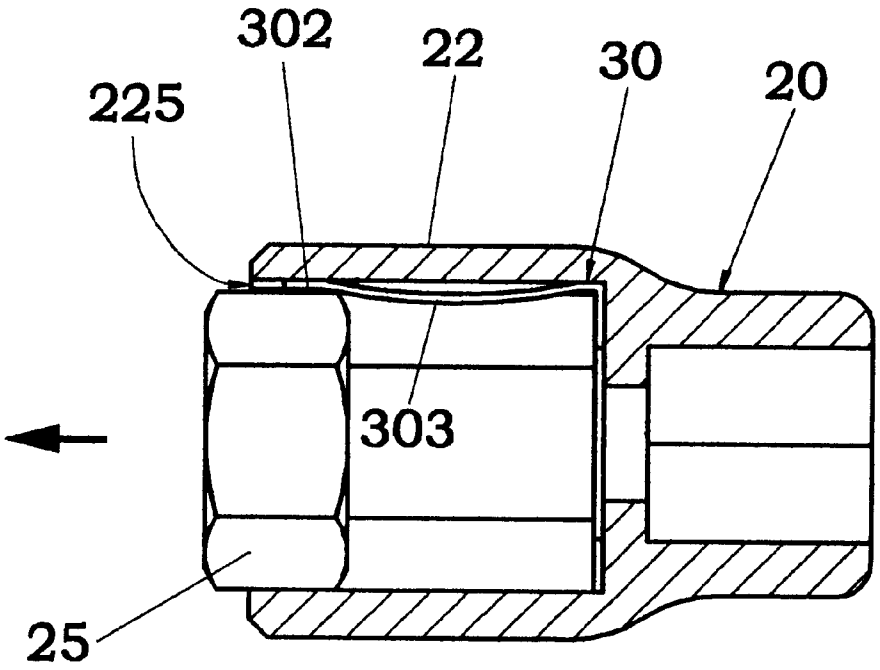
FIG. 7 shows another schematic view of the present invention at work.

As illustrated in FIG.6, a nut 25 is retained in the driven end 22 of the socket spanner 20 such that the nut 25 is urged and held securely by the protruded edge 303 of the elastic body 30. As illustrated in FIG. 7, the nut 25 can be taken out of the driven end 22 without causing the elastic body 30 to become disengaged with the driven end 22.

Figure 8:
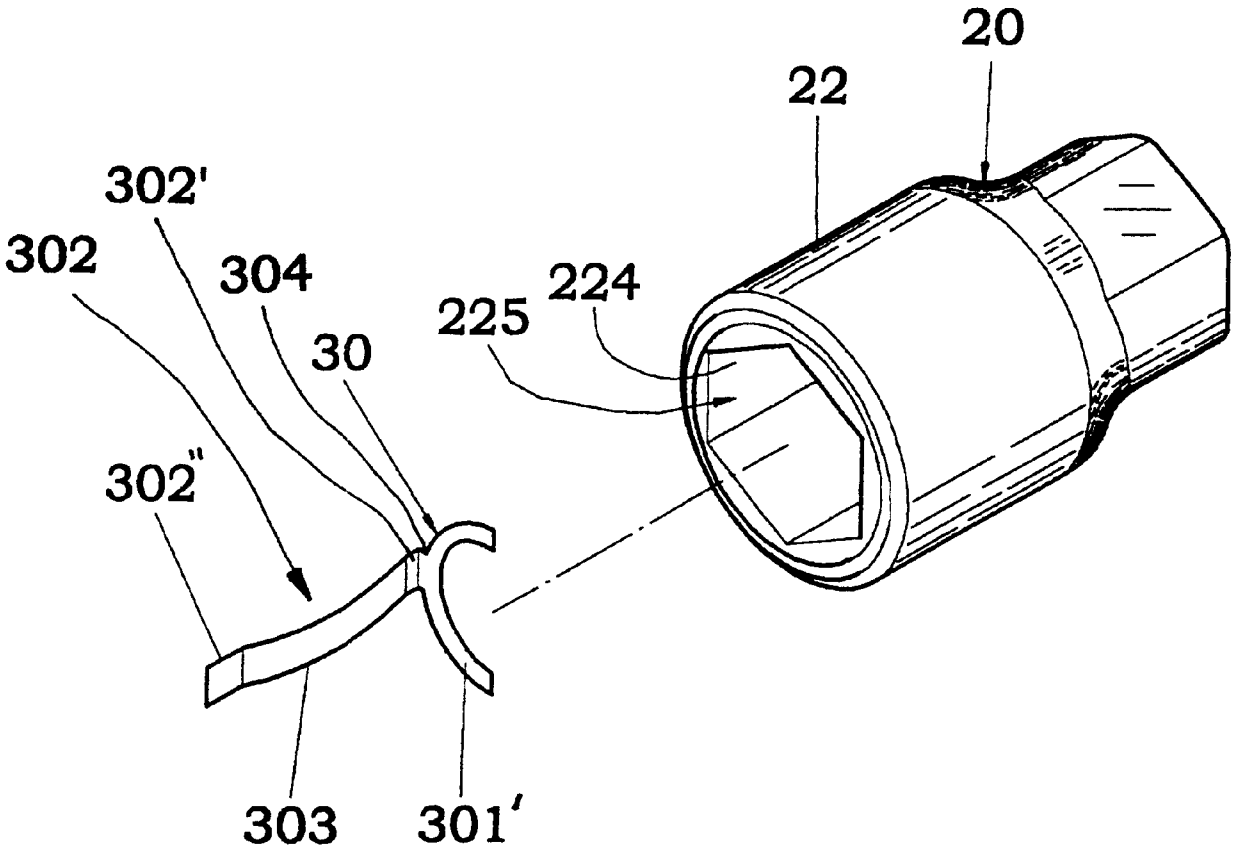
FIG. 8 shows an exploded view of another preferred embodiment of the present invention.

As shown in FIG.8, the socket spanner 20 of the present invention may be modified in such a way that the elastic body 30 is composed of a semicircular press ring 301' and the retaining side 302. The working mechanism of the second preferred embodiment of the present invention is identical with that of the first preferred embodiment of the present invention. It must be noted here that the press portion 301 of the elastic body 30 of the first preferred embodiment of the present invention is of a closed ring construction, and that the press portion 301 of the elastic body 30 of the second preferred embodiment of the present invention is of a semicircular construction.

FIG. 8 also shows that the retaining leg is made of a thin strip having a width substantially greater than its thickness. The retaining leg 302 comprises a bent portion 304, a first straight portion 302", a second straight portion 302', and a radially inwardly protruding portion 303. The bent portion 304 connects the retaining leg with the press portion 301'.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A socket spanner with a retaining device comprising a socket and an elastic body;

wherein said socket has a driven end with a hexagonal hole having six inner side faces;

said elastic body comprising a press portion and a longitudinally extending retaining leg which extends from said press portion, said retaining leg being made of a thin strip having a width substantially greater than its thickness;

said press portion comprising a full-ring with a diameter slightly greater than a distance between two opposing faces of said hexagonal hole so as to allow said elastic body to be received and retained in said hexagonal hole;

said retaining leg comprising a bent portion, a first straight portion, a second straight portion, and a radially inwardly protruding portion, with said bent portion connecting said retaining leg with said press portion;

further wherein said retaining leg is structured to allow a nut to be received in said hexagonal hole, said first and second straight portions being generally parallel to an inner face of said hexagonal hole, and that said radially inwardly protruding portion, which is disposed between said first and second straight portions, is constructed to be pressed against an inner side face of said hexagonal hole by the nut so that said radially inwardly protruding portion exerts an urging force against the nut to retain the nut when the nut is inserted into said hexagonal hole.

2. The socket spanner as defined in claim 1, wherein said bent portion of said retaining leg is structured so that said retaining leg exerts an urging force against an outer wall of a nut received in said hexagonal hole.

3. A socket spanner with a retaining device comprising a socket and an elastic body;

wherein said socket has a driven end with a hexagonal hole having six inner side faces;

said elastic body comprising a press portion and a longitudinally extending retaining leg which extends from said press portion, said retaining leg being made of a thin strip having a width substantially greater than its thickness;

said press portion comprising a half-ring with a diameter slightly greater than a distance between two opposing faces of said hexagonal hole so as to allow said elastic body to be received and retained in said hexagonal hole;

said retaining leg comprising a bent portion, a first straight portion, a second straight portion, and a radially inwardly protruding portion, with said bent portion connecting said retaining leg with said press portion;

further wherein said retaining leg is structured to allow a nut to be received in said hexagonal hole, said first and second straight portions being generally parallel to an inner face of said hexagonal hole, and that said radially inwardly protruding portion, which is disposed between said first and second straight portions, is constructed to be pressed against an inner side face of said hexagonal hole by the nut so that said radially inwardly protruding portion exerts an urging force against the nut to retain the nut when the nut is inserted into said hexagonal hole.

4. The socket spanner as defined in claim 3, wherein said bent portion of said retaining leg is structured so that said retaining leg exerts an urging force against an outer wall of a nut received in said hexagonal hole.

* * * * *